United States Patent [19]

Orova et al.

[11] 4,390,804

[45] Jun. 28, 1983

[54] MAGNETO GENERATOR FOR IGNITION SYSTEMS

[75] Inventors: Josef Orova, Schwabach; Herbert Roderer; Hans D. Schmid, both of Nuremberg; Horst-G. Steffen, Schwarzenbruck, all of Fed. Rep. of Germany

[73] Assignee: Robert Bosch GmbH, Stuttgart, Fed. Rep. of Germany

[21] Appl. No.: 275,517

[22] Filed: Jun. 19, 1981

[30] Foreign Application Priority Data

Jun. 25, 1980 [DE] Fed. Rep. of Germany ..... 3023677

[51] Int. Cl.[3] ..... F02P 1/00; H02K 25/12

[52] U.S. Cl. ..... 310/70 R; 310/153; 310/263

[58] Field of Search ..... 310/70 R, 156, 257, 310/262, 153, 70 R, 257, 262, 269; 123/599, 601; 74/573 R

[56] References Cited

U.S. PATENT DOCUMENTS

| | | | |
|---|---|---|---|
| 1,817,410 | 8/1931 | Heinrich | 310/70 R |
| 3,032,670 | 5/1962 | Fritz | 310/263 |
| 3,513,341 | 5/1970 | Gratzmuller | 310/262 |
| 3,579,277 | 4/1969 | Imahashi | 310/156 |
| 4,295,070 | 10/1981 | Johansson | 310/70 R |

*Primary Examiner*—J. D. Miller
*Assistant Examiner*—D. L. Rebsch
*Attorney, Agent, or Firm*—Frishauf, Holtz, Goodman & Woodward

[57] ABSTRACT

A magneto generator includes a magnet wheel 11 which carries a magnetic system. The magnetic system consists of a plurality of claw shaped pole pieces (12,13) which form extensions of two pole plates (14,15). A plate shaped permanent magnet 16 is positioned between the pole plates in a direction perpendicular to the pole wheel axis. The pole pieces arranged along the periphery of the magnet wheel are extensions of two pole plates each of which abuts one of the pole faces of the plate shaped permanent magnet. At least one of the pole plates has an extension which compensates for the unbalance of weight caused by the pole piece extensions.

8 Claims, 2 Drawing Figures

MAGNETO GENERATOR FOR IGNITION SYSTEMS

CROSS-REFERENCE TO RELATED PATENT AND PUBLICATIONS

U.S. Application Ser. No. 929,855, Filed July 31, 1978, now U.S. Pat. No. 4,188,930, Santi.

The present invention relates to magneto generators for ignition systems. In particular, it relates to magneto generators having a rotating magnetic wheel.

BACKGROUND OF THE INVENTION

U.S. Pat. No. 4,188,930, Santi, discloses a magneto generator in which a flat disc shaped permanent magnet is positioned underneath a central pole piece. Two exterior pole pieces arranged at a distance therefrom on either side are connected by a connecting piece which abuts the lower pole face of the permanent magnet. The central pole piece abuts the whole upper pole face of the permanent magnet. The disadvantage of this arrangement is that the dimension of the permanent magent is limited because of the exterior pole pieces and that therefore the magnetic energy which can be applied to the effective air gap at the pole pieces is also limited by the volume of the permanent magnet.

THE INVENTION

It is an object of the present invention to provide a rotating magnetic system which is thin, i.e. permits use of a relatively narrow magnet wheel, and which is capable of generating high amounts of magnetic energy, preferably using commercially available ring magnets.

In accordance with the present invention, claw shaped pole shoes, or pieces are utilized which form an extension of pole plates located axially against the pole faces of a plate-shaped magnet. At least one of the pole plates has an extension in the region of the magnet wheel opposite the pole pieces which acts to balance the weight of the magnet and/or of the pole pieces If a flat segmental permanent magnet is used, it is preferred that one of the two pole plates has an extension for weight balancing, the extension being either folded or rolled back upon itself and, preferably, also being shaped to form a hub.

DESCRIPTION OF THE PREFERRED EMBODIMENT

Figure 1:
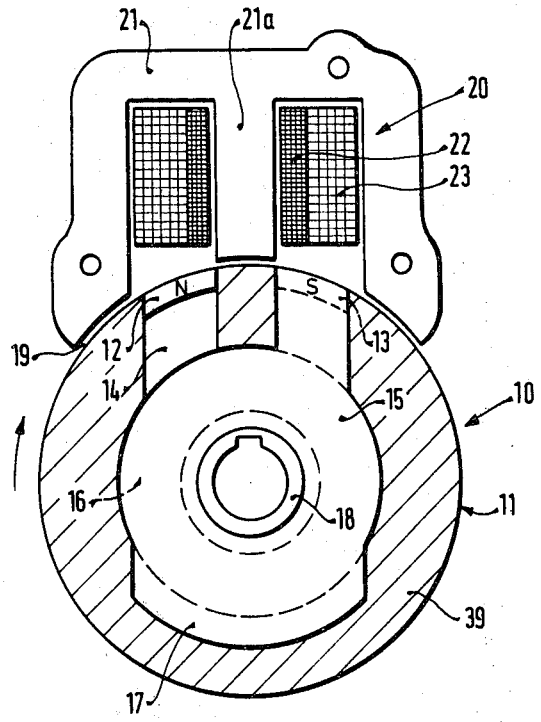
FIG. 1 illustrates a magneto generator for ignition systems, the magneto generator having a magnet wheel in which a magnetic system with a ring magnet is embedded.

FIG. 1 shows a magneto generator 10 for an ignition system. It consists of a rotating magnet wheel 11 which is fastened onto a drive shaft of an internal combustion engine (not shown). Two pole shoes or pole pieces 12 and 13 are arranged side-by-side in the peripheral region of magnet wheel 11. Pole pieces 12 and 13 are claw shaped and form lateral extensions of respective pole plates 14, 15. They extend over only a small portion of the circumference of the wheel 11. The two plates are positioned one behind the other in the axial direction of magnet wheel 11. A ring magnet 16 indicated by dashed lines is positioned between the two plates and has two circular polar surfaces. Since pole pieces 12 and 13 tend to cause an unbalance in rotating magnet wheel 11, each of pole plates 14 and 15 has an extension 17 in the region opposite pole shoes, or pieces 12 and 13 extending circumferentially similarly to the pole pieces 12, 13, so that the weight will be balanced. A magnet wheel hub 18 is fastened in a center bore of pole plates 14 and 15. The hub is non-magnetic. A flat ring magnet 16 is magnetized in the axial direction and causes pole pieces 12 and 13 to be magnetized with opposite polarities. The total magnetic flux leaving pole piece 12 and entering pole piece 13 interacts through an air gap 19 with an ignition armature 20. Ignition armature 20 has an E-shaped iron core 21. Armature 20 is arranged externally in the peripheral region of magnet wheel 11 and is fastened to the housing of the internal combustion engine. The center leg **21*a* of the iron core carries a primary winding 22 and secondary winding 23 wound over winding 22. The ends of the legs of iron core 21 are spaced from magnet wheel 11 by air gap 19**.

For each rotation in the direction of the arrow of magnet wheel 11, pole pieces 12 and 13 of magnet wheel 11 are moved once underneath the ends of the legs of ignition armature 20. The width of pole pieces 12 and 13 and the distance therebetween are so chosen that in predetermined rotational positions of the magnet wheel the two pole pieces are opposite the ends of respective pairs of legs of ignition armature 20. During rotation of magnet wheel 11, the magnetic flux in the center leg **21*a* first increases to a maximum in one direction. During further rotation, a certain break position (FIG. 1) is reached in which the magnetic flux in center leg 21*a* abruptly changes its direction. This change in flux causes an electromotive force to be generated in the primary and secondary windings 22,23** which may, as is well known, be used to initiate ignition in the internal combustion engine.

Figure 2:
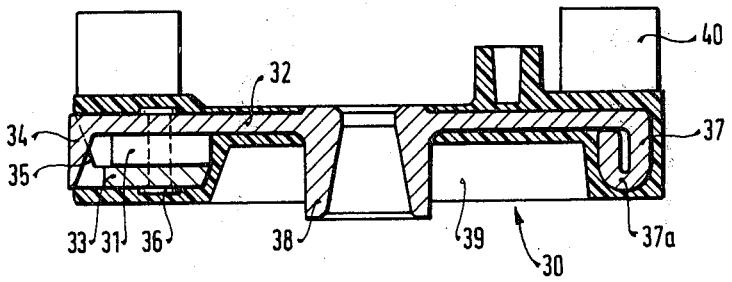
FIG. 2 illustrates a magnet wheel utilizing a segmental permanent magnet.

In FIG. 2, a cross-section of a magnet wheel 30 of a magneto generator for ignition systems is illustrated in which a flat segmental permanent magnet 31 is arranged between two pole plates 32 and 33 instead of the ring magnet of FIG. 1. Here too, two claw shaped pole pieces 34, 35 are extensions of, i.e. integral with, respective pole plates 32 and 33. Again, the pole pieces are positioned at the periphery of the magnet wheel. A pole plate 33 is segmentally shaped, as is permanent magnet 31. Permanent magnet 31 is fastened by a rivet 36 between pole plates 32 and 33 as viewed in the axial direction of magnet wheel 30. Each of the pole faces of permanent magnet 31 abuts one of the pole plates. Again, the magnet wheel has to be balanced with respect to weight and the unbalance caused by the magnetic system is compensated for by an extension 37 of pole plate 32 opposite pole pieces 34 and 35. The end **37*a* of extension 37 is bent a number of times. A through opening in pole plate 32 with extension 37 forms the hub 38 for fastening magnet wheel 30** onto the drive shaft of the internal combustion engine.

In both embodiments, the hubs, pole plates and permanent magnets are embedded in a body 39 made of a synthetic substance, aluminum, or other non-magnetic material which defines the shape of the magnet wheel. Optionally, fan blades 40 may be formed on one face of the magnet wheel. The construction of the magnet wheel according to the present invention allows permanent magnets, preferably ferrite magnets having a very high field strength, to be arranged in a direction perpendicular to the axis of the magnet wheel, thereby increasing the surface area of the pole faces and therefore the total magnetic flux required to saturate the latter. The magnetic system may, of course, also consist of more than two pole pieces.

Various changes and modifications may be made within the scope of the inventive concepts.

We claim:

1. Magneto generator for an ignition system comprising a rotating magnet wheel (10);

a plate shaped permanent magnet (16, 31) embedded in said magnet wheel, said permanent magnet having a first and second pole face at opposite axial sides thereof;

a first and second pole plate (14, 15; 32, 33) respectively abutting said first and second pole face and located at respective first and second axial positions of said magnet wheel, each of said first and second pole plate having a radially extending portion and an axially extending claw shaped pole shoe (12, 13; 34, 35) located at the periphery of the wheel, said pole shoes being located circumferentially adjacent each other, projecting axially across said permanent magnet and spanning a minor portion of the circumference of said magnet wheel; and at least one of said pole plates having a weight compensating extension (17, 37) in the region of the magnet wheel radially opposite said pole shoes.

2. Magneto generator as set forth in claim 1, wherein said permanent magnet is a ring magnet (16) arranged around the axis of said magnet wheel, and has circular pole faces each abutting one of said pole plates.

3. Magneto generator as set forth in claim 1, wherein one of said pole plates (32, 33) has a segmental shape;

said permanent magnet (31) has a segmental shape; and wherein said one of said pole plates and said permanent magnet are fastened to the other of said pole plates.

4. Magneto generator as set forth in claim 1, wherein said weight compensating extension includes an end portion having at least one bend to form an axially positioned portion.

5. Magneto generator as set forth in claim 4, wherein one of the pole plates is formed with said weight compensating extension; and wherein a hub for said magnet wheel is provided integrally formed on said pole plate having the bent end portion on said weight compensating extension.

6. Magneto generator as set forth in claim 1, wherein said permanent magnet is a ring magnet (16) arranged around the axis of said magnet wheel, and has circular pole faces each abutting one of said pole plates;

and wherein each one of said pole plates is formed with a weight compensating extension (17).

7. Magneto generator as set forth in claim 6, wherein the weight compensating extensions (17) have a circumferential extent similar to that of the pole shoes (12, 13).

8. Magneto generator as set forth in claim 1, wherein the at least one weight compensating extension extends circumferentially similarly to the circumferential extent of the pole shoes (12, 13).

* * * * *